US005215875A

United States Patent [19]

Matejec et al.

[11] Patent Number: 5,215,875

[45] Date of Patent: Jun. 1, 1993

[54] COLOR PHOTOGRAPHIC RECORDING MATERIAL

[75] Inventors: Reinhart Matejec, Leverkusen; Hans Vetter, Cologne; Heinrich Odenwälder, Leverkusen, all of Fed. Rep. of Germany

[73] Assignee: Agfa Gevaert Aktiengesellschaft, Leverkusen, Fed. Rep. of Germany

[21] Appl. No.: 712,258

[22] Filed: Jun. 7, 1991

[30] Foreign Application Priority Data

Jun. 23, 1990 [DE] Fed. Rep. of Germany ..... 4020058

[51] Int. Cl.[5] ..... G03C 1/46

[52] U.S. Cl. ..... 430/505; 430/373; 430/943; 430/377; 430/546; 430/566; 430/367; 430/567

[58] Field of Search ..... 430/373, 943, 377, 546, 430/566, 367, 505, 567

[56] References Cited

U.S. PATENT DOCUMENTS

| | | | |
|---|---|---|---|
| 3,705,035 | 12/1972 | Vetter et al. | 430/239 |
| 4,269,924 | 5/1981 | Janssens et al. | 430/212 |
| 4,371,609 | 2/1983 | Kajiwaro et al. | 430/373 |
| 4,469,780 | 9/1984 | Hirai et al. | 430/373 |
| 4,473,635 | 9/1984 | Ishikawa et al. | 430/505 |
| 4,954,425 | 9/1990 | Iwano | 430/373 |
| 5,057,402 | 10/1991 | Shiba et al. | 430/377 |
| 5,108,877 | 4/1992 | Asami | 430/377 |

OTHER PUBLICATIONS

Scott, B. A., "Recent Patents", The British Journal of Photography, p. 692, Jul. 20, 1979.

*Primary Examiner*—Charles L. Bowers, Jr.
*Assistant Examiner*—Thomas R. Neville
*Attorney, Agent, or Firm*—Connolly & Hutz

[57] ABSTRACT

A color photographic recording material comprising at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler and typical intermediate and protective layers, in which the silver halide coating of all the photosensitive layers, expressed as $AgNO_3$, amounts to no more than 0.3 $g/m^2$ and the color-coupler-containing layers contain at least one p-phenylenediamine compound containing at least one primary amino group and at least one ballast group dissolved in hydrophobic oil droplets, can be developed in an environment-friendly manner using an intensifying bath.

5 Claims, No Drawings

COLOR PHOTOGRAPHIC RECORDING MATERIAL

This invention relates to a color photographic recording material which is distinguished by a particularly thin silver coating and which is processed in an environment-friendly manner without any need for an actual color development bath.

It is known that color photographic silver halide materials having a thin silver coating can be processed with an $H_2O_2$-containing intensifying bath following the color development bath (so-called intensification process). It has now been found that color photographic silver halide materials with a thin silver coating can be processed by the intensification method to form excellent color images without having to pass through a color development bath providing they contain at least one p-phenylenediamine compound containing a primary amino group and at least one ballast group dissolved in hydrophobic oil droplets in the color-coupler-containing layers.

The present invention relates to a color photographic recording material comprising at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler and typical intermediate and protective layers, characterized in that the silver halide coating of all the photosensitive layers, expressed as $AgNO_3$, amounts to no more than 0.3 $g/m^2$ and the color-coupler-containing layers contain at least one p-phenylenediamine compound containing at least one primary amino group and at least one ballast group dissolved in hydrophobic oil droplets.

The color photographic material preferably contains a silver chloride bromide emulsion containing 0 05 to 3 mol-% silver bromide as the emulsion in at least one photo-sensitive layer. More particularly, at least 50% of the silver bromide is situated at the surface of the silver halide crystals. Emulsions of this type are obtained in particular by treating AgCl emulsions and AgClBr emulsions containing less bromide than required with an aqueous solution of a bromide after sensitization. The emulsions of all the photosensitive layers are preferably AgClBr emulsions in which the bromide contents may vary from layer to layer within the indicated limits.

The silver halides preferably have a bromide content of 0.2 to 2 mol-%.

In addition, the silver halide crystals may contain up to 0.5 mol-% silver iodide, but are preferably free from silver iodide.

The color couplers and the p-phenylenediamine compound are preferably dissolved together in a high-boiling hydrophobic solvent ("oil former"), this solution being emulsified in an aqueous gelatine solution.

The p-phenylenediamine compound corresponds in particular to the following formula

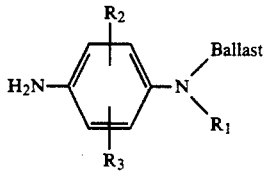

in which

Ballast is a ballast group, more particularly a $C_{10-20}$ alkyl group, $R_1$ is an optionally substituted $C_{2-4}$ alkyl group containing in particular at least one OH, $SO_3H$, COOH or $CH_3SO_2NH$ group as substituent, $R_2$ and $R_3$ are hydrogen or $C_{1-4}$ alkyl.

Suitable compounds correspond to the following formulae

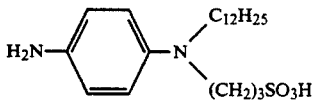

E 1

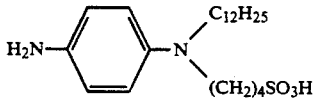

E 2

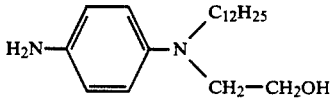

E 3

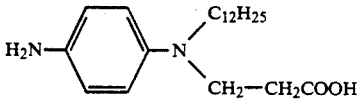

E 4

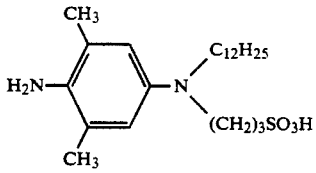

E 5

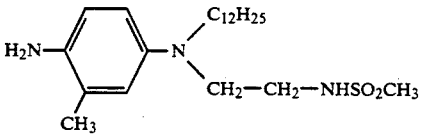

E 6

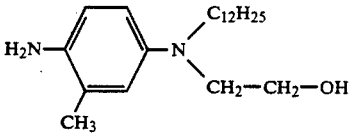

E 7

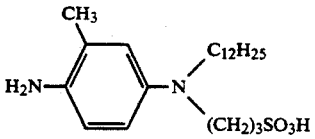

E 8

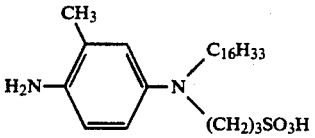

E 9

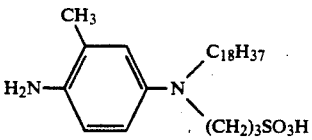

E 10

-continued

E 11

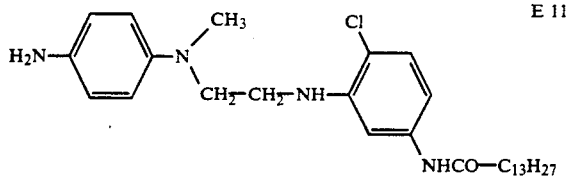

E 12

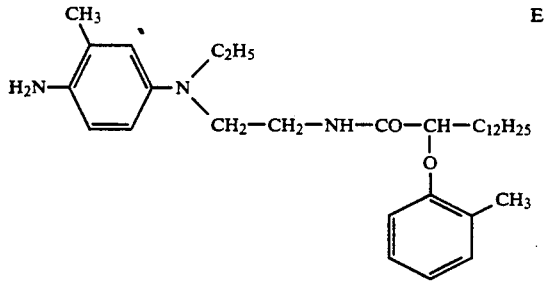

The p-phenylenediamine compounds containing at least one ballast group are also understood to include p-phenylenediamine compounds with which a latex is charged.

Another possibility is to charge identical or different latices both with color couplers and with p-phenylenediamine compounds, cf. for example DE-A-25 41 230, DE-A 25 41 274, DE-A-28 35 856, EP-A 0 014 921, EP-A 0 069 671, EP-A 0 130 115 and U.S. Pat. No. 3,291,113.

The color photographic recording material preferably consists of a reflective support to which a blue-sensitive layer containing at least one yellow coupler, a green-sensitive layer containing at least one magenta coupler and a red-sensitive layer containing at least one cyan coupler and typical intermediate and protective layers are applied in that order.

The silver halide coating, expressed as $AgNO_3$, preferably amounts to between 0,05 and 0.3 g/m$^2$.

The present invention also relates to an image-producing process for the material mentioned above, in which the material is treated after exposure with aqueous $H_2O_2$.

The concentration of $H_2O_2$ is preferably from 0.5 to 25 g/l.

In one preferred embodiment, the color photographic material or the intensifying bath contains a black-and-white developer (for example phenidone, hydroquinone, metol, amidol) in a quantity of 0.01 to 1.0 g/l.

Intensification may be followed by the usual steps of bleaching, fixing, rinsing and drying; bleaching and fixing may be carried out in one and the same bath (bleaching/fixing bath). However, one particular advantage of the process is that the small amount of silver halide produces such a weak silver image which does not adversely affect the dye image and, accordingly, need not be removed. Accordingly, there is no need for bleaching. There is also no need for fixing (dissolving of the unexposed silver halide) providing the silver halide is converted by a stabilizing bath into a non-photosensitive silver complex salt. In this case, stabilization may be immediately followed by drying.

In addition to the silver halide crystals and the color couplers, the silver halide emulsion layers essentially contain a binder which is also the main constituent of the intermediate and protective layers.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine). Gelatines of high viscosity and low swelling are particularly advantageous.

The silver halides used in accordance with the invention may consist of predominantly compact crystals which may have, for example, a regular cubic or octahedral form or transitional forms. The silver halides may also consist of platelet-like crystals of which the average aspect ratio is, for example, at least 5:1, the diameter of a crystal being defined as the diameter of a circle with an area corresponding to the projected area of the crystal. However, the layers may also contain platy silver halide crystals in which the aspect ratio is considerably greater than 5:1, for example from 12:1 to 30:1.

The average grain size of the emulsions is preferably between 0.2 μm and 2.0 μm; the grain size distribution may be both homodisperse and heterodisperse. A homodisperse grain size distribution means that 95% of the grains deviate by no more than ±30% from the average grain size. Homodisperse silver halide emulsions or mixtures thereof are preferred. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al, Making and Coating Photographic Emulsion, The Focal Press, London 1966)).

Precipitation of the silver halide is preferably carried out in the presence of the binder, for example gelatine, and may be carried out in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, whereby the "critical" feed rate at which new nuclei are not yet formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Salts or complexes of metals, such as Cd, Zn, Pb, Tl, Bi, Ir, Rh, Fe, may also be present during the precipitation and/or physical ripening of the silver halide grains.

In addition, precipitation may even be carried out in the presence of sensitizing dyes. Complexing agents and/or dyes may be inactivated at any time, for example by changing the pH value or by an oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and stabilizer concentration) until sensitivity and fogging are both optimal. The process is described, for example, in H. Frieser "Die Grundlagen der Photographischen Prozesse mit Silberhalogeniden", pages 675–734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964, and in Ullmanns Encyclopädie der technischen Chemie, 4th Edition, Vol. 18, pages 431 et seq and Research Disclosure 17643 (December 1978), Chapter III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage or photographic processing.

Particularly suitable compounds of this type are azaindenes, preferably tetra- and pentaazindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure 17 643 (December 1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfur or phosphoric acid esters of an aminoalcohol. Other suitable surfactants are fluorine-containing surfactants which are known, for example, from GB-PS 1,330,356, 1,524,631 and U.S. Pat. Nos. 3,666,478 and 3,689,906.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643 (December 1978), Chapter IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia- or selenocarbocyanines and 9-ethyl naphthothiaoxa- and benzimidazocarbocyanines, providing the dye contains at least one sulfoalkyl group at the heterocyclic nitrogen;

2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

Color couplers for producing the cyan component dye image are generally couplers of the phenol or α-naphthol type. Color couplers for producing the magenta component dye image are generally couplers of the 5-pyrazolone type, the indazolone type or the pyrazoloazole type. Color couplers for producing the yellow component dye image are generally couplers containing an open-chain ketomethylene group, more especially couplers of the benzoyl acetanilide and α-pivaloyl acetanilide type. Numerous examples of the couplers are described in the literature.

The couplers may also be high molecular weight couplers, so-called latex couplers.

High molecular weight couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers, the p-phenylenediamine derivatives or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. No. 2,322,027, U.S. Pat. No. 2,801,170, U.S. Pat. No. 2,801,171 and EP-A-0 043 037.

Instead of using high-boiling solvents, it is also possible to use oligomers or polymers, so-called polymeric oil formers.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octyl aniline, paraffin, dodecylbenzene and diisopropyl naphthalene.

Each of the differently sensitized photosensitive layers may consist of a single layer or may even comprise two or more partial silver halide emulsion layers.

The non-photosensitive intermediate layers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers, are described in Research Disclosure 17 643 (December 1978), Chapter VII, 17 842 (February 1979) and 18 716 (November 1979), page 650 and in EP-A-0 069 070, 0 098 072, 0 124 877, 0 125 522.

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UV-rich daylight. Compounds of different structure are normally used for the two functions. Examples are arylsubstituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

Particularly suitable UV absorbers should absorb light up to 400 nm and should fall steeply in their light absorptivity at wavelengths above 400 nm.

The following are examples of particularly suitable compounds:

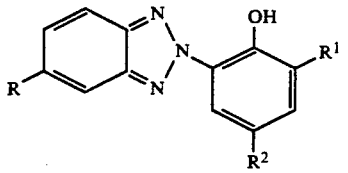

R, $R^1$ = H; $R^2$ = $-C_4H_{9}$-t

R = H; $R^1$, $R^2$ = $-C_4H_{9}$-t

R = H; $R^1$, $R^2$ = $-C_5H_{11}$-t

R = H; $R^1$ = $-C_4H_{9}$-s; $R^2$ = $-C_4H_{9}$-t

R = Cl; $R^1$ = $-C_4H_{9}$-t; $R^2$ = $-C_4H_{9}$-s

R = Cl; $R^1$, $R^2$ = $-C_4H_{9}$-t

R = Cl; $R^1$ = $-C_4H_{9}$-t; $R^2$ = $-CH_2-CH_2-COOC_8H_{17}$

R = H; R = $-C_{12}H_{25}$-i; $R^2$ = $-CH_3$

R, $R^1$, $R^2$ = $-C_4H_{9}$-t

-continued

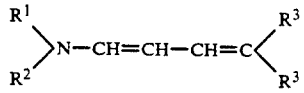

$R^1, R^2 = -C_6H_{13\text{-}n}$; $R^3, R^4 = -CN$ $R^1, R^2 = -C_2H_5$; $R^3 = -SO_2-$ 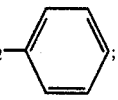 ;

$R^4 = -CO-OC_8H_{17}$ $R^1, R^2 = -C_2H_5$; $R^3 = -SO_2-$ 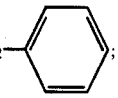 ;

$R^4 = -COO-C_{12}H_{25}$ $R^1, R^2 = -CH_2=CH-CH_2$; $R^3, R^4 = -CN$

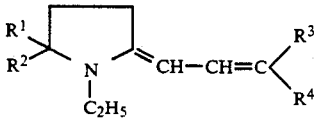

$R^1, R^2 = H$; $R^3 = -CN$; $R^4 = -CO-NHC_{12}H_{25}$ $R^1, R^2 = -CH_3$; $R^3 = -CN$; $R^4 = -CO-NHC_{12}H_{25}$

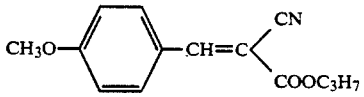

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, in U.S. Pat. Nos. 2,632,701 and 3,269,840 and in GB-A-852,075 and 1,319,763.

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure 17 643 (December 1978), Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643 (December 1978), Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593 are particularly effective for preventing the impairment of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment of magenta-red dye images, particularly their impairment as a result of the effect of light.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen U.S. Pat. No. (3,288,775, U.S. Pat. No. 2,732,303, GB-A-974,723 and GB-A-1,167,207), divinylsulfone compounds, 5-acetyl-1,3-diacryloyl hexahydro-1,3,5-triazine and other compounds containing a reactive olefin bond (U.S. Pat. No. 3,635,718, U.S. Pat. No. 3,232,763 and GB-A-994,869); N-hydroxymethyl phthalimide and other N-methylol compounds (U.S. Pat. No. 2,732,316 and U.S. Pat. No. 2,586,168); isocyanates (U.S. Pat No. 3,103,437); aziridine compounds (U.S. Pat. No. 3,017,280 and U.S. Pat. No. 2,983,611); acid derivatives (U.S. Pat. No.2,725,294 and U.S. Pat. No. 2,725,295); compounds of the carbodiimide type (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type (U.S. Pat. No. 3,321,313 and U.S. Pat. No. 3,543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

Suitable examples of instant hardeners are compounds corresponding to the following general formulae:

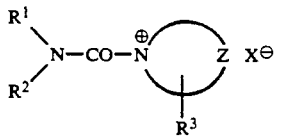

(a)

in which $R^1$ is alkyl, aryl or aralkyl, $R^2$ has the same meaning as $R^1$ or represents alkylene, arylene, aralkylene or alkaralkylene, the second bond being attached to a group corresponding to formula

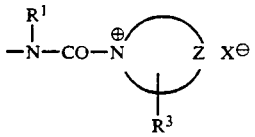

or $R^1$ and $R^2$ together represent the atoms required to complete an optionally substituted heterocyclic ring, for example a piperidine, piperazine or morpholine ring, the ring optionally being substituted, for example, by $C_{1-3}$ alkyl or halogen, $R^3$ is hydrogen, alkyl, aryl, alkoxy, $—NR^4—COR^5$, $—(CH_2)_m—NR^8R^9$, $—(CH_2)_n—CONR^{13}R^{14}$ or $$—(CH_2)_p—\underset{\underset{R^{15}}{|}}{CH}—Y—R^{16}$$

or is a bridge member or a direct bond to a polymer chain, $R^4$, $R^6$, $R^7$, $R^9$, $R^{14}$, $R^{15}$, $R^{17}$, $R^{18}$ and $R^{19}$ being hydrogen or $C_1$–$C_4$ alkyl, $R^5$ being hydrogen, $C_{1-4}$ alkyl or $NR^6R^7$, $R^8$ being $—COR^{10}$, $R^{10}$ being $NR^{11}R^{12}$, $R^{11}$ being $C_{1-4}$ alkyl or aryl, particularly phenyl, $R^{12}$ being hydrogen, $C_{1-4}$ alkyl or aryl, particularly phenyl, $R^{13}$ being hydrogen, $C_{1-4}$ alkyl or aryl, particularly phenyl, $R^{16}$ being hydrogen, $C_{1-4}$ alkyl, $COR^{18}$ or $CONHR^{19}$, m being a number of 1 to 3, n being a number of 0 to 3, p being a number of 2 to 3 and Y being O or $NR^{17}$ or $R^{13}$ and $R^{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^\ominus$ is an anion which is unnecessary where an anionic group is already attached to the rest of the molecule;

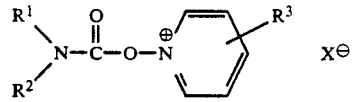

(b)

in which $R^1$, $R^2$, $R^3$ and $X^\ominus$ are as defined for formula (a).

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more particularly iron(III) complexes of, for example, ethylenediamine tetraacetic acid, propylenediamine tetraacetic acid, diethylenetriamine pentaacetic acid, nitrilotriacetic acid, iminodiacetic acid, N-hydroxyethyl ethylenediamine triacetic acid, alkyliminodicarboxylic acids and of corresponding phosphonic acids. Other suitable bleaches are persulfates and peroxides, for example hydrogen peroxide.

The bleaching/fixing bath or the fixing bath is generally followed by rinsing which is carried out as countercurrent rinsing and consists of several tanks each with its own water supply.

Favorable results can be obtained where a finishing bath containing little or no formaldehyde is subsequently used.

However, rinsing may be completely replaced by a stabilizing bath which is normally operated in countercurrent. If formaldehyde is added, this stabilizing bath also performs the function of a finishing bath.

EXAMPLE 1

A color photographic recording material was prepared by application of the following layers in the order indicated to a layer support of paper coated with polyethylene on both sides. The quantities shown are all based on 1 $m^2$. For the silver halide coating, the corresponding quantities of $AgNO_3$ are shown. All the emulsions were stabilized with 0.8 g butyl benztriazole/100 g $AgNO_3$. Before casting, all the casting solutions were adjusted to pH 5.5.

Layer combination 1 (comparison)

1st layer (substrate layer):

0.3 g gelatine

2nd (blue-sensitive layer)

0.09 g $AgNO_3$ of a spectrally blue-sensitized $AgCl_{0.994}Br_{0.005}I_{0.001}$ emulsion, mean particle diameter 0.8 μm 1.42 g gelatine 0.95 g yellow coupler GB 1
1.0 g tricresyl phosphate
3rd layer (intermediate layer)
1.1 g gelatine
0.06 g 2,5-dioctyl hydroquinone
0.06 g dibutyl phthalate
4th layer (green-sensitive layer):
0.62 g $AgNO_3$ of a spectrally green-sensitized $AgCl_{0.995}Br_{0.005}$ emulsion, mean particle diameter 0.6 μm
1.20 g gelatine
0.41 g magenta coupler PP 1
0.35 g dibutyl phthalate
0.25 g tricresyl phosphate
5th layer (UV-absorbing layer)

7th layer (UV-absorbing layer)
0.60 g gelatine
0.2 g UV absorber (as in the 5th layer)
0.1 g tricresyl phosphate
8th layer (hardener layer)
0.9 g gelatine
0.2 g hardener corresponding to the following formula

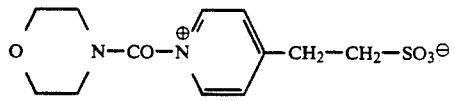

Color couplers used:

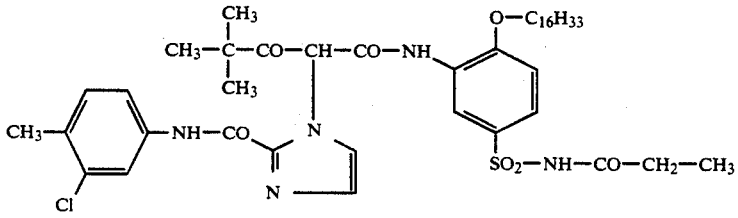

GB 1

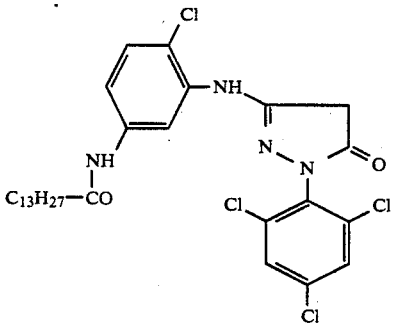

PP 1

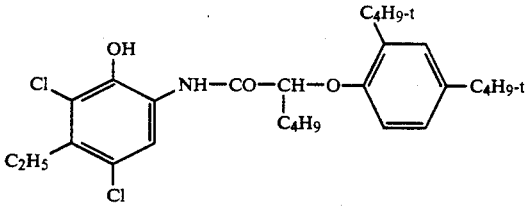

BG 1

1.3 g gelatine
0.56 g UV absorber corresponding to the following formula

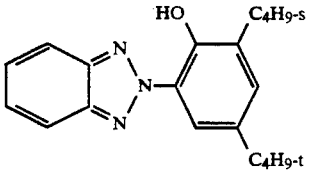

0.3 g tricresyl phosphate
6th layer (red-sensitive layer)
0.054 g $AgNO_3$ of a spectrally red-sensitized $AgCl_{0.993}Br_{0.007}$ emulsion having a mean particle diameter of 0.55 μm,
0.85 g gelatine
0.38 g cyan coupler BG 1
0.38 g tricresyl phosphate Layer combination B (comparison)

As layer combination 1A, but with addition of 0.10 g phenidone/$m^2$ to the 2nd layer, 0.08 g phenidone/$m^2$ to the 4th layer and 0.07 g phenidone to the 6th layer.

Layer combination C (invention)

As layer combination A, except that 0.95 g GB 1 and 0.5 g E 6 are emulsified together in TCP in the 2nd layer;
0.41 g PP 1 and 0.28 g E 6 are emulisified together in TCP in the 4th layer;
0.38 g BG 1 and 0.30 g E 6 are emulsified together in TCP in the 6th layer.

Layer combination D (invention)

As layer combination C, except that the quantities of phenidone mentioned in layer combination B are additionally added to the 2nd, 4th and 6th layers.

Layer combination E (invention)

As layer combination C, except that E 6 is replaced by the same quantity of E 2; E 2 was emulsified in TCP separately from the color coupler.

Layer combination F (invention)

As layer combination E, except that the quantities of phenidone mentioned in regard to layer combination B are added to the 2nd, 4th and 6th layers.

Layer combinations A to F thus prepared were exposed for 1/100 s behind a grey step wedge in a sensitometer and processed in the following baths:

Intensifying bath I

| Developer-intensifier solution | |
|---|---|
| Polyglycol P 400 | 22 ml |
| Diethyl hydroxylamine (85% by weight) | 6 ml |
| Color developer CD 3 | 10 g |
| Potassium sulfite | 0.33 g |
| 1-Hydroxyethane-1,1-diphosphonic acid | 0.14 g |
| Potassium hydrogen carbonate | 5 g |
| Potassium carbonate | 22 g |
| Potassium hydroxide | 8 g |
| Dodecyl benzene sulfonate | 0.02 g |
| Hydrogen peroxide (35% by weight) | 10 ml |
| Make up with water to 1000 ml; pH 10.6 | |

Since the color developer reacts slowly with the hydrogen peroxide in the solution itself, the solution was freshly prepared just before use.

Intensifying bath II

Aqueous hydrogen peroxide (0.5% by weight) adjusted to pH 10.6 with KOH, followed by addition of 0.5 g phenidone to 1000 ml.

Intensifying bath III

As intensifying bath II, but without the phenidone.

Fixing solution

| | |
|---|---|
| Ammonium thiosulfate | 50 g |
| Sodium sulfite | 5 g |
| Sodium hydrogen sulfite | 2 g |
| Make up with water to 1000 ml; pH 6.0 | |

Processing of samples A to F:

| | | |
|---|---|---|
| Intensifying bath | 35° C. | 20 secs |
| Fixing bath | 23° C. | 20 secs |
| Rinsing | 23° C. | 60 secs |

Since the quantity of the developed silver was only very small in all the samples and in all the processing stages, the bleaching stage was omitted.

The color density curves of samples A to F thus processed were measured behind blue, green and red filters; the sensitometric data are shown in Table 1.

As can be seen from this Table, the phenidone-free, color-developer-free, environment-friendly intensifying bath III only gives useful sensitometric data (i.e. as in the case of the comparison bath I) with layer combinations D and F according to the invention; by contrast, the phenidone-containing, color-developer-free, environment-friendly bath even gives useful sensitometric data with the (phenidone-free) layer combinations C and E according to the invention.

TABLE 1

| Sample | Intensifying bath | Layer combination | $D_{min}$ y | $D_{min}$ mg | $D_{min}$ cy | $D_{max}$ y | $D_{max}$ mg | $D_{max}$ cy | $S_{rel}$ log (I.T) y | $S_{rel}$ log (I.T) mg | $S_{rel}$ log (I.T) cy |
|---|---|---|---|---|---|---|---|---|---|---|---|
| 1 | I | A | 0.15 | 0.10 | 0.09 | 2.72 | 2.68 | 2.55 | 24.0 | 23.8 | 24.3 |
| 2 | | B | 0.16 | 0.11 | 0.11 | 2.76 | 2.70 | 2.52 | 24.2 | 24.0 | 24.1 |
| 3 | | C | 0.19 | 0.20 | 0.22 | 2.78 | 2.73 | 2.56 | 24.3 | 23.9 | 23.8 |
| 4 | | D | 0.20 | 0.22 | 0.21 | 2.64 | 2.62 | 2.48 | 24.0 | 24.0 | 23.9 |
| 5 | | E | 0.17 | 0.18 | 0.16 | 2.79 | 2.80 | 2.62 | 24.3 | 24.1 | 23.9 |
| 6 | | F | 0.19 | 0.18 | 0.17 | 2.58 | 2.60 | 2.50 | 23.6 | 23.5 | 23.2 |
| 7 | II | A | 0.07 | 0.09 | 0.09 | 0.20 | 0.22 | 0.21 | — | — | — |
| 8 | | B | 0.09 | 0.10 | 0.12 | 0.24 | 0.25 | 0.24 | — | — | — |
| 9 | | C | 0.16 | 0.15 | 0.15 | 2.65 | 2.64 | 2.60 | 23.8 | 23.3 | 23.6 |
| 10 | | D | 0.17 | 0.16 | 0.15 | 2.83 | 2.78 | 2.69 | 23.2 | 23.3 | 23.4 |
| 11 | | E | 0.14 | 0.15 | 0.14 | 2.70 | 2.64 | 2.54 | 23.9 | 23.8 | 23.6 |
| 12 | | F | 0.16 | 0.16 | 0.15 | 2.88 | 2.82 | 2.70 | 24.4 | 24.3 | 24.1 |
| 13 | III | A | 0.00 | 0.00 | 0.00 | 0.00 | 0.00 | 0.00 | — | — | — |
| 14 | | B | 0.08 | 0.10 | 0.11 | 0.15 | 0.15 | 0.16 | — | — | — |
| 15 | | C | 0.03 | 0.03 | 0.04 | 0.50 | 0.48 | 0.49 | — | — | — |
| 16 | | D | 0.16 | 0.14 | 0.15 | 2.68 | 2.58 | 2.54 | 23.8 | 23.4 | 23.6 |
| 17 | | E | 0.04 | 0.05 | 0.02 | 0.54 | 0.53 | 0.52 | — | — | — |
| 18 | | F | 0.18 | 0.12 | 0.13 | 2.74 | 2.72 | 2.63 | 24.3 | 24.6 | 24.0 |

We claim:

1. A color photographic recording material comprising at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler and typical intermediate and protective layers, characterized in that the total silver halide coating of the photosensitive layers, expresses as $AgNO_3$, amounts to no more than 0.3 g/m$^2$, the color-coupler-containing layers contain at least one p-phenylenediamine compound

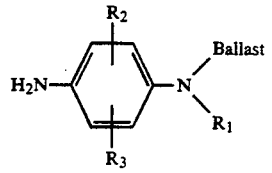

in which

Ballast is a ballast group, $R_1$ is a $C_{2-4}$ alkyl group substituted by at least one OH, $SO_3H$, COOH or $CH_3SO_2NH$ group, $R_2$ and $R_3$ are hydrogen or $C_{1-4}$ alkyl, dissolved in hydrophobic oil droplets and the emulsions of all photosensitive layers are AgClBr emulsions containing 0.05 to 3 mol-% silver bromide in which at least 50% of the silver bromide is present at the surface of the silver halide crystals.

2. A color photographic recording material as claimed in claim 1, characterized in that the silver bromide content is from 0.2 to 2 mol-%.

3. A color photographic recording material as claimed in claim 1, characterized in that the bromide contents of the silver chlorobromides of the individual photosensitive layers are different.

4. A color photographic recording material as claimed in claim 1, characterized in that the silver halide coating, expressed as $AgNO_3$, amounts to between 0.05 and 0.2 $g/m^2$.

5. A color photographic development process, characterized in that an exposed material according to claim 1 is subjected to intensification with $H_2O_2$.

* * * * *